United States Patent [19]

Cox

[11] Patent Number: 4,548,063

[45] Date of Patent: Oct. 22, 1985

[54] TENSION CONTROL IN A METAL ROLLING MILL

[75] Inventor: Howard N. Cox, Roanoke, Va.

[73] Assignee: General Electric Company, Salem, Va.

[21] Appl. No.: 624,137

[22] Filed: Jun. 25, 1984

[51] Int. Cl.[4] ..... B21B 37/02; B21B 37/06; B21B 39/02

[52] U.S. Cl. ..... 72/16; 72/17; 72/19; 72/205

[58] Field of Search ..... 72/205, 16, 17, 8, 19

[56] References Cited

U.S. PATENT DOCUMENTS

| | | | |
|---|---|---|---|
| 3,162,069 | 12/1964 | McLay et al. | 72/205 X |
| 3,169,424 | 2/1965 | Branscom et al. | 72/16 X |
| 3,312,091 | 4/1967 | Kobayashi | 72/19 X |
| 3,869,892 | 3/1975 | Higham et al. | 72/16 X |

FOREIGN PATENT DOCUMENTS

| | | | |
|---|---|---|---|
| 2201142 | 4/1974 | France | 72/16 |
| 0858967 | 8/1981 | U.S.S.R. | 72/16 |
| 1014614 | 4/1983 | U.S.S.R. | 72/8 |

OTHER PUBLICATIONS

"Selection of Electrical Equipment for Temper and Skin Pass Mills" by J. E. Peebles et al., *Iron and Steel Engineering*, Sep. 1958, pp. 115-128.

*Primary Examiner*—Francis S. Husar
*Assistant Examiner*—Steven B. Katz
*Attorney, Agent, or Firm*—Arnold E. Renner

[57] ABSTRACT

A metal rolling mill for reducing the thickness of a metal workpiece passed between a pair of opposed work rolls is controlled to maintain substantially constant tension in the workpiece on the entry side of the work rolls to thereby improve the uniformity of the workpiece gate at the mill output. Working in conjunction with a standard control for delivering the workpiece is a scheme for compensating for thickness variations in the workpiece at the entry side of the work rolls which variations would result in tension changes which would adversely affect output gage consistency.

8 Claims, 4 Drawing Figures

TENSION CONTROL IN A METAL ROLLING MILL

BACKGROUND OF THE INVENTION

The present invention relates generally to metal rolling mills and more particularly to a method of compensating for tension changes in a workpiece at the entry side of a pair of opposed roller elements (work rolls) which tension changes are occasioned by thickness variations in the workpiece as it enters between the work rolls to be reduced in thickness.

In a metal rolling mill, one of the prime objectives is to produce a product having uniform thickness or gage. In a typical rolling mill, the workpiece is supplied in the form of a coil (payoff coil) from which it is unreeled and supplied, in certain instances by way of powered puller rolls, to one or more mill stands of opposed pairs of work rolls to be reduced in thickness. After reduction, the workpiece may be wound on another coil called the takeup coil. As is understood in the discipline, workpiece thickness, or gage, is essentially a function of the roll separation force and/or the tension within the workpiece. With respect to tension, that on the entry side of the work rolls is of the greater importance.

Since the amount of material delivered from payoff coil must equal the amount of material which is placed upon the takeup coil, the volume flow over a period of time is constant. As such, since in a metal rolling mill the workpiece width and the work roll speed are each essentially constant, it is apparent that the velocity of the workpiece at the entry side of a mill stand multiplied by its thickness must be equal to the product of the velocity and the thickness of the workpiece at the exit side of the stand.

From the above discussion, if it is now assumed that the exit thickness and the velocity are set, essentially, by the rolling force and work roll speed, it is intuitively apparent and mathematically true that any change in the thickness at the entry side of the stand will inversely affect the entry side velocity. This change in velocity has, in prior art controls, resulted in a change in tension at the entry side of the work rolls which in turn resulted in a change in delivery thickness and hence an "off-gage" product.

Prior art controls have provided power to the payoff coil to adjust the output torque thereof to provide the desired level of tension and to maintain tension constant as the torque arm changes when the coil diameter changes. During planned mill accelerations and decelerations of the workpiece, torque changes are made to prevent the inertia of the payoff coil system from affecting tension.

When powered puller rolls are present, the roll diameters of these drives remain constant so it is not necessary to account for changing torque arms or changing inertia. As with the payoff coil drive, torque is adjusted for obtaining the desired level of tension and for planned mill accelerations and decelerations to prevent the fixed inertia from affecting tension. These systems do not, however, compensate for velocity changes within the workpiece, due to changes in the entry thickness, which result in the change in tension and hence gage.

SUMMARY OF THE INVENTION

It is, therefore, an object of the present invention to provide an improvement in the control of workpiece gage in a metal rolling mill.

It is a further object to provide an improvement in the control of output workpiece gage of a metal rolling mill through the improved control of workpiece tension.

It is still another object to provide an improved method of controlling workpiece tension in a metal rolling mill by compensating for workpiece thickness variations at the entry side of a mill stand.

It is a still further object to provide an improved method of controlling the output gage of a metal rolling mill through the more precise control of tension in a workpiece by compensating for thickness variations at the entry side of a stand and through the modification of the standard mill control.

The foregoing and other objects are achieved in accordance with the present invention by providing, in a metal rolling mill which includes a stand having a pair of opposed roller elements for reducing the thickness of a workpiece passed therebetween, a system for compensating for tension changes in the workpiece at the entry side of the mill stand which are occasioned by the variations in the workpiece thickness. In accordance with this method, sequential workpiece segments of a prescribed length are defined and any change in thickness within a segment is determined. Also determined is the time at which a workpiece segment enters between the roller elements. Based upon any change in thickness, the anticipated rate of change in the velocity of the workpiece at the entry side of the roll mill stand is determined and in response to this anticipated change, the workpiece tension at the entry side of the work rolls is controlled to a substantially constant value.

BRIEF DESCRIPTION OF THE DRAWING

While the present invention is defined in particularity in the claims annexed to and forming a part of this specification, a better understanding of the invention can be had by reference to the following description taken in conjunction with the accompanying drawings in which:

DETAILED DESCRIPTION

Figure 1:
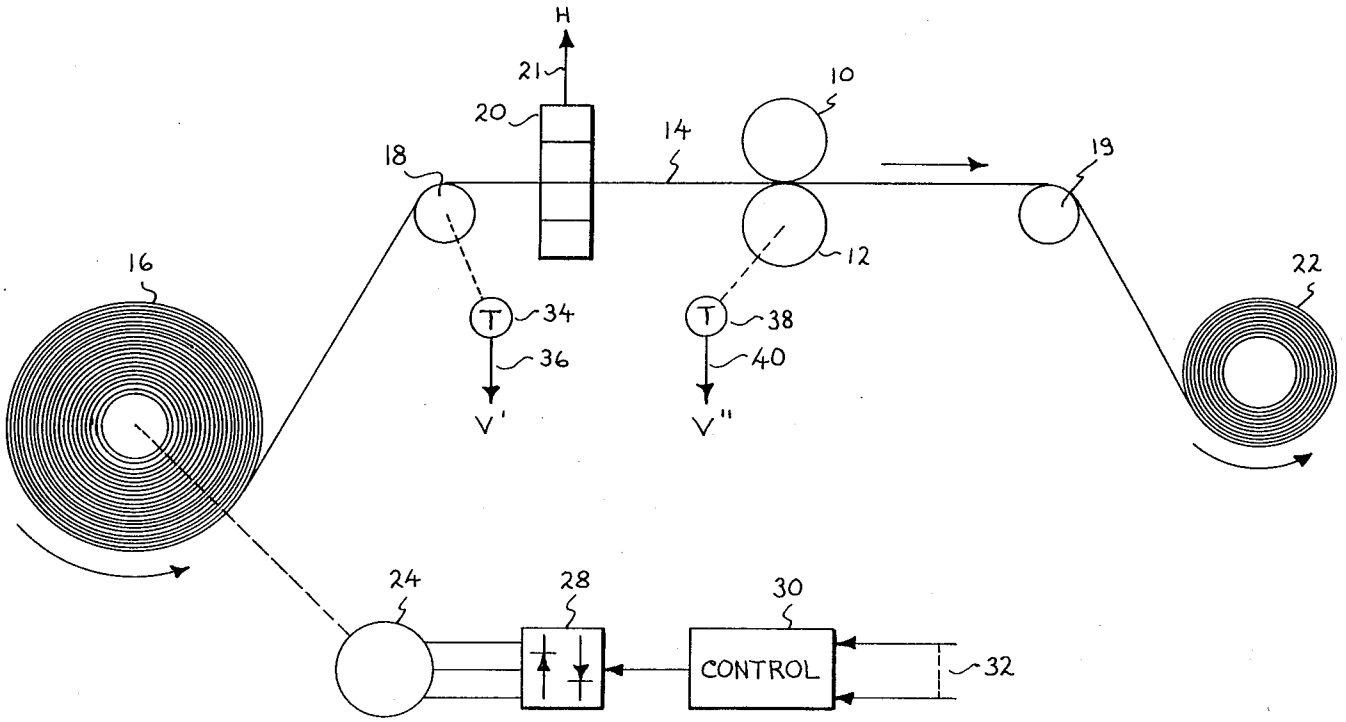
PRIOR ART FIG. 1
FIG. 1 is a schematic diagram which depicts a single stand rolling mill, one type of mill within which the present invention finds application.

Reference is now made to FIG. 1 which shows, in schematic form, a typical single stand mill in association with which the present invention may be practiced; although, it will be apparent to those skilled in the art that the present invention is not limited to single stand mills but could be applied to tandem mills as well.

Referencing now FIG. 1, it is seen that provided are two opposed work rolls 10 and 12 between which a workpiece 14 is passed for the purpose of being deformed as by a reduction in thickness. It is well understood by those skilled in the art that the work rolls 10 and 12 are driven by suitable motors and are maintained within an appropriate housing having means such as screw or hydraulic mechanisms for adjusting the gap or opening between the two rolls and for maintaining a desired rolling force. For sake of simplicity, these items which are well understood within the art have not been included in the FIG. 1 showing. Workpiece 14 is supplied to the work rolls from a payoff coil 16. The workpiece 14 passes from that coil over a suitable deflector roll 18 and by a device 20 for measuring workpiece thickness (e.g., an X-ray gage). At the output or exit side of the mill, the workpiece 14 passes over a second deflector roll 19 and from there to a suitable takeup coil 22. Rolls 18 and 19 may be driven by suitable motors which have not been shown; although frequently these rolls are undriven.

Both the payoff coil 16 and the takeup coil 22 are driven by suitable motor systems. The motor for a takeup coil 22 is not shown here since it is not involved in the present invention. Payoff coil 16 is shown powered by a motor 24 the output torque of which is varied, as is known in the prior art, in proportion to the radius of coil 16 and, as will be described, in accordance with the present invention. In the illustrated example, motor 24 is supplied with variable power from a power supply 28 which is under the functional control of a suitable control 30 responsive to input signals 32. As a typical example of such control and such as might be employed in association with the present invention, reference is made to "Selection of Electrical Equipment for Temper and Skin Pass Mills" by J. E. Peebles et al., *Iron and Steel Engineering*, September 1958, pages 115–128.

An additional factor normally necessary in a rolling mill and which is necessary for the operation of the present invention is some means of obtaining the velocity of the workpiece. In FIG. 1, two possible sources are illustrated. The first of these consists of a tachometer 34 associated with the deflector roll 18. Tachometer 34 may be connected directly to the roll or to a motor powering the roll and could be of either the digital or analog type. Most commonly, in today's mill which employs computers, the digital type tachometer would be employed. The output of tachometer 34, signal V′ on line 36, is proportional to the rotational speed of roll 18 and is, therefore, assuming no slippage between the roll and the workpiece, directly proportional to the linear velocity of the workpiece by the factor of the roll diameter. An alternate method of obtaining workpiece entry velocity would be to provide a similar type of tachometer shown at 38, associated with a one of the work rolls 10 or 12 to provide an output signal V″ on a line 40. This velocity signal should be increased by a forward slip factor with an approximate value of 1.05 and reduced by the ratio of measured delivery to entry thickness to obtain a value which once again could be used to represent linear entry speed of the workpiece. Other means such as surface inspection devices, for example laser velocimeters, could also be used. The important thing insofar as the present invention is concerned is that there be at least a close approximation of the entry linear speed of the workpiece.

The thickness measuring device 20 provides an output signal H on line 21 which is proportional to the extant gage (thickness) of the workpiece at the device. As was indicated, device 20 typically is an X-ray gage but other forms of gages, such as isotope or mechanical contacting gages, could be used with equal facility.

Control 30 responds to input control signals on lines 32 and is, inter alia, designed to compensate for coil diameter changes in the payoff coil and to adjust the payoff coil drive torque during mill speed changes to prevent tension changes being caused by the need to supply or extract energy from the payoff coil drive system. Control 30 also permits the selection of the magnitude of torque (e.g., by the varying motor current) to provide the desired level of entry tension.

The standard control 30 is not, per se, a part of the present invention and if further information with respect thereto is desired, reference is again to be made to the aforementioned Peebles et al. article. As earlier stated, the present invention in the embodiment being described is designed to work into or in cooperation with such a control.

Figure 2:
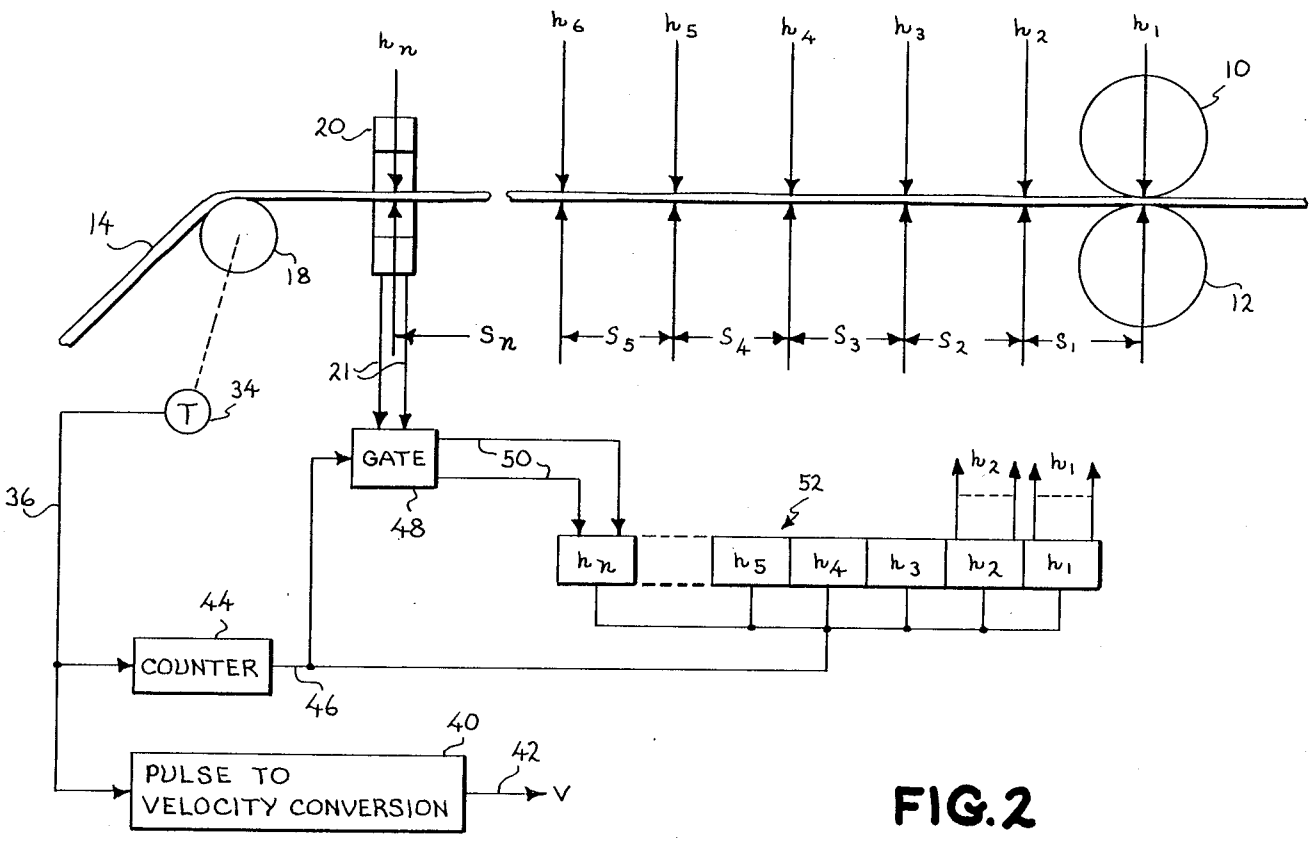
FIG. 2 is a schematic representation of a portion of a metal rolling mill, associated workpiece and a portion of the associated control which illustrates several features useful in understanding of the present invention.

FIG. 2 demonstrates the generation of certain signals which are employed in the present invention and further demonstrates various relationships with respect to the mill. In FIG. 2, the work rolls 10 and 12 are again shown as is the workpiece 14. In the implementation of the method of the present invention, the workpiece is considered as sequential segments $S_1$ to $S_n$ of equal length L. The segments are illustrated in FIG. 2 to the left of the work rolls 10 and 12 and are each shown to have a length L as measured between successive "h" measurements. The exact length of the individual segments is somewhat arbitrary and generally, the shorter the segment, the more accurate the system. The minimum segment size will, of course, be limited by practical considerations such as computational time, computer capabilities, etc.

The thickness variations of the segments are determined in order to effect a signal which is representative of the rate of change of the velocity entering the work rolls due to thickness changes. In FIG. 2, workpiece thickness variations are shown greatly exaggerated and it is seen that two thickness measurements are taken with respect to each segment—one at the leading edge and one at the trailing edge. Thus, the workpiece length between indicators $h_1$ and $h_2$ is one workpiece segment ($S_1$), that between $h_2$ and $h_3$ the next segment ($S_2$) and so forth. The $h_1$, $h_2$ . . . $h_n$ designations are intended to represent the thickness measurements taken at their respective points and it is apparent that after the initial measurement the trailing edge measurement of one segment also serves at the leading edge measurement for the next segment.

In FIG. 2, deflector roll 18 with its associated tachometer 34 provides a signal suitable for gating and for velocity measurement purposes. For purposes of this illustration, tachometer 34 may be considered a digital tachometer providing a string of output pulses on line 36 at a rate proportional to the speed of the deflector roll and hence, the velocity of the workpiece. These pulses may be utilized for several purposes. First of all, the pulses may be applied to a pulse to velocity conversion circuit 40 which, as is known in the art, counts the number of pulses in a given interval of time to provide an output signal V on line 42 which will be representative of workpiece velocity. The pulses on line 36 may also be supplied to a suitable device such as a ring counter 44 which will provide an output signal on line 46 each time the counter reaches a given count which represents a given length of the workpiece (segment length L in this illustration).

In FIG. 2, thickness measuring device 20 is shown providing signals on its output lines 21 which are representative of the extant thickness of the workpiece at the device. The signals on lines 21 are supplied to a gate 48 which further receives the signal on line 46. Each time a signal appears on line 46, gate 48 is enabled and the signals from the measuring device 20 are furnished to the input end of a suitable queue store such as a shift register 52. This same signal on line 46 may be employed to sequentially shift subsequent readings from the measuring device through the shift register such that by properly correlating the number of readings in the register to the distance between the measuring device 20 and the work rolls 10 and 12, there will appear in the two most right hand portions of the register (here indicated as $h_1$ and $h_2$) quantities representing the leading and trailing edge thickness measurements of that workpiece segment which is immediately to enter between the work rolls.

Figure 3:
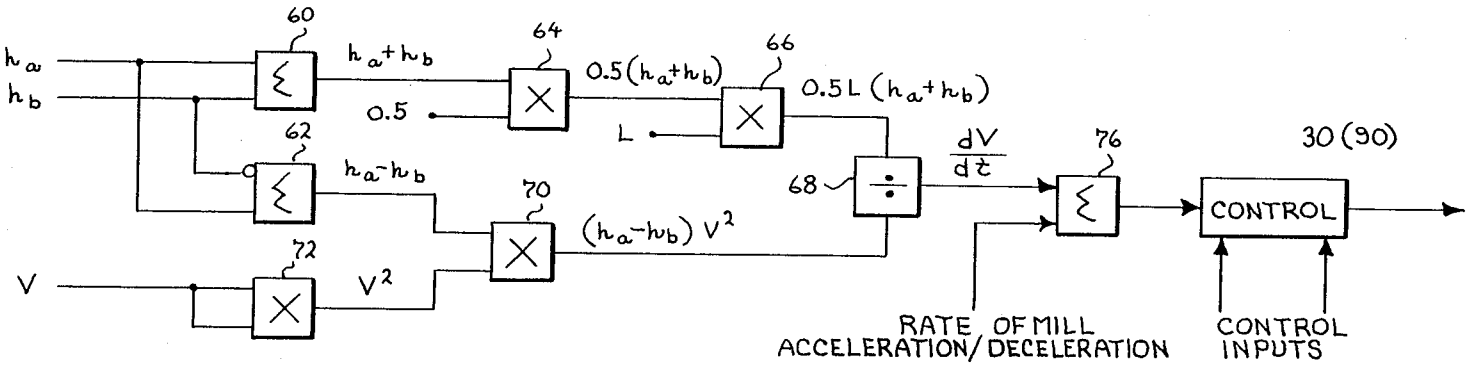
FIG. 3 is a schematic functional representation of an implementation of a method of the present invention in its preferred embodiment, shown in association with a typical control of the prior art.

Reference is now made to FIG. 3 which illustrates, in functional form, one implementation of the method of the present invention. It will be apparent that the present invention may be implemented by either analog or digital means. In today's industrial world the more likely form of implementation would be by digital means and attached hereto, as Appendix A forming a part of this specification, is a computer listing written in Control Block language capable of being run on a Digital Equipment PDP 11/44 computer which listing constitutes such a digital implementation.

Specifically referencing now FIG. 3, it will be recalled that it was earlier stated that the basic mill control 30 compensates for mill speed changes. This is normally achieved through the application of a signal representative of the rate of mill acceleration/deceleration in accordance with the previously referenced article by Peebles et al.

It is the function of the present invention to compensate for anticipated workpiece velocity changes caused by thickness variations by providing a signal which is proportional to the rate of acceleration or deceleration of the workpiece resulting from such a change in thickness; i.e., a change in strip velocity as a function of time (dv/dt). In accordance with the preferred embodiment of the present invention, this dv/dt signal is defined by the relationship $$\frac{dv}{dt} = \frac{(h_a - h_b)}{0.5\,(h_a + h_b)} \cdot \frac{V^2}{L}$$

and is combined with the prior art rate of mill acceleration/deceleration to effect overall control of the payoff reel. In this equation, the various terms are defined as:

$h_a$=determined workpiece thickness at the leading edge of workpiece segment;

$h_b$=determined workpiece thickness at the trailing edge of workpiece segment;

V=linear velocity of workpiece entering between work rolls;

L=length of workpiece segment.

As such the term $$\frac{(h_a - h_b)}{0.5\,(h_a + h_b)}$$

is the per unit (percentage) thickness change in the segment over the length thereof while the $V^2/L$ term is the acceleration factor.

The functional implementation of this formula shown in FIG. 3 provides that the $h_a$ and $h_b$ signals (the thickness signals at the ending and trailing edges of a segment) are applied to a first summing function 60 to provide a summed output $h_a+h_b$. These same two signals are also provided in a subtractive mode to a summing function 62 which provide an output $h_a-h_b$. The output of function 60 is applied as one input to a multiplying function 64, the other input of which is a signal representing 0.5 such that the output of that function is $0.5\,(h_a+h_b)$. This latter output forms one input to an additional multiplying function 66, the other input to which is a signal L proportional to the length of the segment. (The L signal proportional to segment length is, in any given situation, an operator settable constant and will, of course, correspond to the full count of counter 44 in FIG. 2.) Thus, the output of function 66 is the denominator of the above equation and serves as one input to a division function 68. The output of the function 62, the $(h_a-h_b)$ signal forms one input to a multiplication function 70, the other input of which is a signal representing the square of the velocity ($V^2$) derived from a multiplication function 72 which has, applied to both inputs thereof, a signal V proportional to the velocity, such as the signal derived on line 42 in FIG. 2. The output of function 70 is, therefore, a signal representing the numerator, $(h_a-h_b)V^2$, of the above equation and this signal serves as the second input to the division function 68, the output of which, in accordance with the above equation, will be the dv/dt signal for the workpiece. The dv/dt signal is developed for each of the sequential segments at the time the respective segment reaches the work rolls and is applied to a summing function 76, the other input of which is, in accordance with the known art, a signal proportional to the rate of mill acceleration or deceleration as normally implemented. The output of this summing function 76 is applied to control 30 which will now respond to an acceleration/deceleration signal which has been modified in accordance with the present invention.

Control 30 may, of course, be provided with other control signals such as the tension reference signal and a velocity signal. These other parameters do not, however, form a part of the present invention and their general inclusion in FIG. 3 is only for purposes of illustration completeness.

Figure 4:
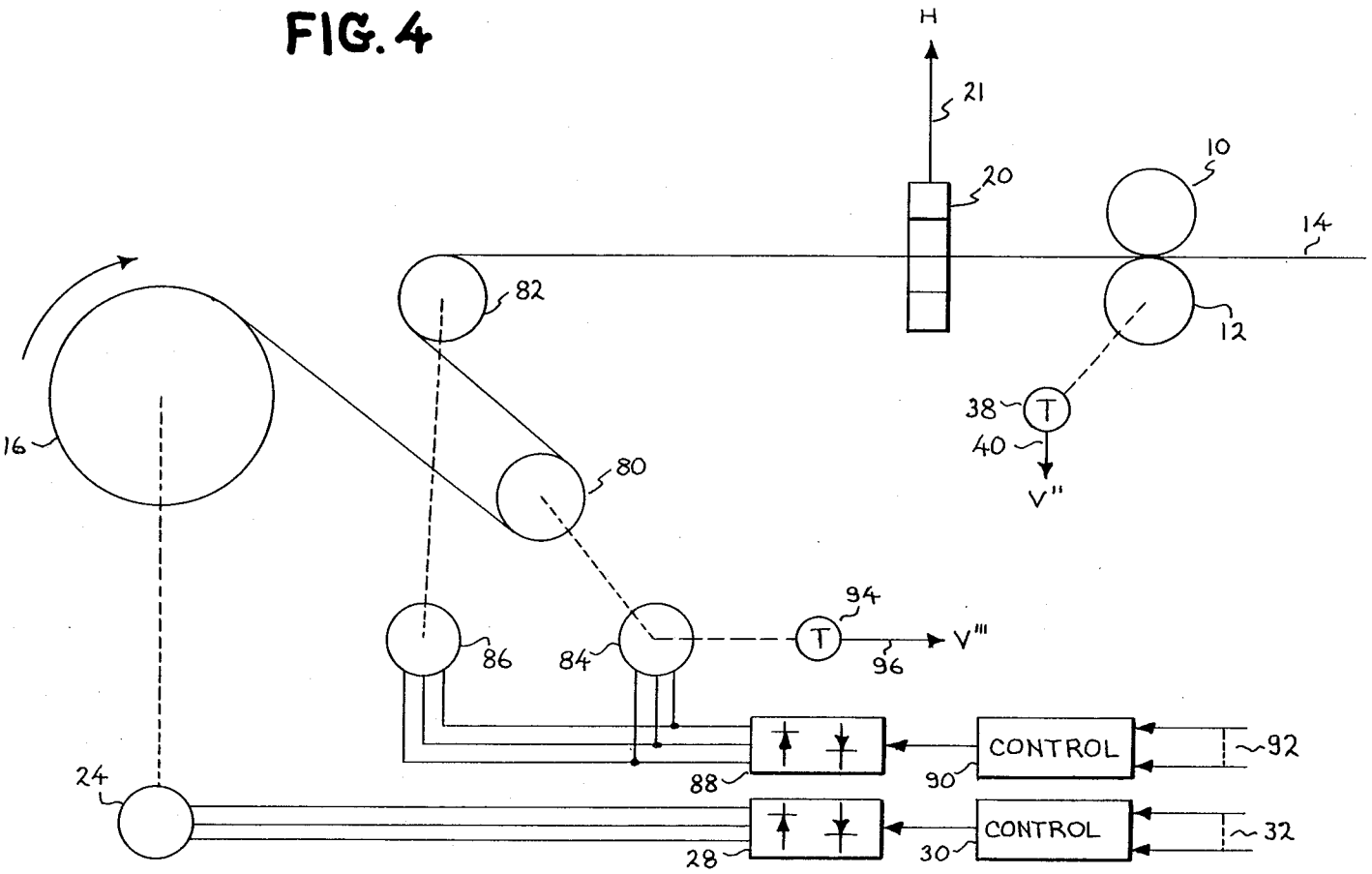
FIG. 4 is a schematic representation of an alternate mill configuration for the practice of the present invention.

FIG. 4 illustrates a second possible application of the present invention in a rolling mill employing powered puller rolls located intermediate the payoff coil and the work rolls. As was the situation described with respect to FIG. 1, a workpiece 14 is furnished to work rolls 10 and 12 from a payoff coil 16. Coil 16 is powered by motor 24 supplied with electrical power from a source 28 in response to the output of a control 30. Also as earlier described, a suitable thickness gage provides thickness output signals 21 and the workpiece velocity may be determined from the output V'' of a tachometer 38 associated with work roll 12. In a manner similar to that described in FIG. 1 with respect to tachometer 34, an alternate method of obtaining a workpiece velocity signal is through the employment of a tachometer 94 associated with one of the puller rolls (e.g. roll 86) to provide an output V''' on line 96.

In FIG. 4, two powered puller rolls 80 and 82 are positioned intermediate coil 16 and work rolls 10 and 12. The output torques of the rolls 80 and 82 result from the operation of respective motors 84 and 86 which, in this example, are connected in parallel to a power source 88, the output of which is controlled by a control 90 in response to inputs 92. The function of the puller rolls is to control tension in the workpiece as is described in the forementioned Peebles et al. article. The control 90 is similar to control 30 as described in that article excepting that compensation for reel inertia and torque arm changes due to radius change is not necessary and is, therefore, not present.

Insofar as the present invention is concerned, FIG. 3 is applicable if control 90 is substituted for control 30 as indicated by the parenthetical representation in that Figure. In all other aspects the application is the same. That is, the dv/dt signal is combined with the prior art acceleration/deceleration signal to provide the required compensation to both controls 30 and 90 simultaneously.

Thus, it is seen that there has been provided a system which accurately and efficiently compensates for variations in thickness of the workpiece which would, in turn, modify the tension resulting in gage changes to the detriment of the overall product quality.

While there has been shown and described what are at present considered to be the preferred embodiments of the present invention, modifications thereto will readily occur to those skilled in the art. For example, the previous description describes the present invention applied to the drive of the payoff coil or to both the drives of the payoff and puller rolls. It is apparent that the present invention could be utilized with other entry drive configurations. Also, the specific relationship for determining the dv/dt value earlier specified is one designed for accuracy while maintaining simplicity. Using the previously defined designations, other relationships such as:

$$\frac{dv}{dt} = \frac{h_a - h_b}{h_a} \cdot \frac{V^2}{L}\text{; or}$$

$$\frac{dv}{dt} = \frac{h_a - h_b}{h_b} \cdot \frac{V^2}{L}$$

could be employed and still retain the basic benefits of the invention. It is not desired, therefore, that the invention be limited to the specific embodiment shown and described and it is intended to cover in the appended claims all such modifications as fall within the true spirit and scope of the invention.

APPENDIX A

LOGIC FOR ENTRY THICKNESS DEVIATION, ENTRY LENGTH

```
BLOCK AICB,400,PCDEVR,A:@INP-
  22E,P:0.0000611,R:1
BLOCK AICB,410,PCDEVR,A:-
  @INP22CP:0.0000611,R:1
BLOCK AICB,420,$A420,A:@INP229,P:1.0,R:3
BLOCK AMPY,425,$A425,A:$ARW0,B;@LBRIPP
BLOCK AICB,430,$A430,A:@INP22A,P:;1.0,R:3
BLOCK AMPY,435,$A435,A:$A430,B:@RBRIPP
BLOCK ANSW,440,HESET,A:@XRSETR,B:@X-
  RSETL,C:PCB0,D:&LF
BLOCK ANSW,450,HDSET,A:@XRSETL,B:@X-
  RSETR,C:PCB0,D:&LF
BLOCK ANSW,460,PCDLHE,A:@PCDEVR,B:@P-
  CDEVL,C:PCB0,D:&LF
BLOCK ANSW,470,PCDLHD,A:@PCDEVL,B:@P-
  CDEVR,C:PCB0,D:&LF
BLOCK ANSW,480,@DELLNG,Y:@LNGINC,A:-
  $A425,B:$A435,C:PCB0,D:&LF
BLOCK ANSW,490,$A490,A:HESET,B:PCDLHE
BLOCK AMPY,500,DHDMEA,A:H-
  DSET,B:PCDLHD
BLOCK ASUM,510,$A510,A:HESET,B:-HDSET
BLOCK ASUM,520,HEMEAS,A:HESET,B:$A490
BLOCK ASUM,530,HDMEAS,A:HDSET,B:DHD-
  MEA
BLOCK ACMP,540,EXLTDX,A:$A510,B:-
  &MILO,P:<
BLOCK LSHT,550,$P550,A:EXLTDX
BLOCK LORI,551,@LARXRS,Y:$P55-
  0,A:&LT,B:&LT
BLOCK LAND,560,$L560,A:PCB0,B:GTPAS1
BLOCK ANSW,570,ENTLNG,A:&ELENHR,B-
  :&ELENHL,C:$L56,D:&LF
CALCULATE THE INERTIA COMPENSA-
TION REFERENCE
BLOCK ADVD,700,$A700,Y:FFCALC,A:F-
  FREFF,B:MFREFF
BLOCK AMPY,705,$A705,Y:FFCALC,A:-
  VEFPM,B:0.2
BLOCK AMPY,710,$A710,Y:FFCALC,A:$A705,B-
  :$A705
BLOCK AMPY,720,$A720,Y:FFCALC,A:$A700,B-
  :$A710
BLOCK AMPY,730,$A730,Y:FFCALC,A:$A720,B:-
  &REAFIV
BLOCK AMPY,740,$A740,Y:FFCALC,A:-
  $A730,B:&KFIVE
BLOCK AMPY,750,FFIC,Y:FFCALC,A:$A740,-
  B:ENTLNG
```

What is claimed:

1. In a rolling mill including a pair of opposed work rolls for reducing the thickness of a workpiece passed therebetween and a delivery system for supplying the workpiece to said work rolls, a method for compensating for anticipated variations in the tension in the workpiece at the entry side of the work rolls occasioned by variations in workpiece thickness comprising:

(a) variably supplying torque to said delivery system to thereby control the tension in the workpiece entering between the work rolls;

(b) defining sequential segments of prescribed length of said workpiece;

(c) determining the time at which a defined workpiece segment enters between said work rolls;

(d) determining any differential in workpiece thickness within a defined workpiece segment;

(e) determining an anticipated rate of change in velocity in the workpiece at the entry side of said work rolls resulting from any differential workpiece thickness determined; and (f) adjusting the torque supplied to said delivery system coil as a function of said anticipated rate of change in velocity to thereby maintain the tension in said workpiece substantially constant.

2. The invention in accordance with claim 1 wherein the differential in thickness for a workpiece segment is defined by the difference in thickness between the leading and trailing edges of said segment.

3. The invention in accordance with claim 1 further including the step of determining the linear velocity of said workpiece and wherein the anticipated rate of change in velocity of said workpiece is determined by:

(a) determining a per unit change in workpiece thickness over a segment length; and (b) multiplying said per unit change by the ratio of the square of said velocity divided by the segment length.

4. The invention in accordance with claim 1 further including the step of determining the linear velocity of said workpiece entering between said work rolls and wherein the step of determining the anticipated rate of change in velocity is determined in accordance with the relationship $$\frac{dv}{dt} = \frac{(h_a - h_b)}{0.5\,(h_a + h_b)} \cdot \frac{V^2}{L},$$

wherein, dv/dt=anticipated rate of change in velocity;

$h_a$=determined workpiece thickness at the leading edge of workpiece segment;

$h_b$=determined workpiece thickness at the trailing edge of workpiece segment;

V=linear velocity of workpiece entering between the work rolls;

L=length of workpiece segment.

5. The invention in accordance with claim 1 including repeating steps (a) through (e) for each of the defined segment lengths.

6. The invention in accordance with claim 4 including repeating steps (a) through (e), as recited in claim 1, for each of the defined segment lengths.

7. The invention in accordance with claim 1 wherein the delivery system includes a powered payoff coil from which said workpiece is delivered to said work rolls and wherein the step of adjusting the torque is accomplished by adjusting the torque furnished to said payoff coil.

8. The invention in accordance with claim 1 wherein the delivery system includes powered puller rolls for delivering said workpiece to said work rolls and wherein the step of adjusting the torque is accomplished by adjusting the torque furnished to said powered puller rolls.

* * * * *